United States Patent [19]

Föller et al.

[11] Patent Number: 4,842,913

[45] Date of Patent: Jun. 27, 1989

[54] SOUND PROTECTION SUIT

[75] Inventors: Dieter Föller, Weiterstadt; Jürgen Tews, Wächtersbach, both of Fed. Rep. of Germany

[73] Assignee: Battelle-Institut e.V., Frankfurt am Main, Fed. Rep. of Germany

[21] Appl. No.: 52,594

[22] Filed: May 21, 1987

[30] Foreign Application Priority Data

May 21, 1986 [DE] Fed. Rep. of Germany ..... 3617088

[51] Int. Cl.[4] ..... B32B 3/00

[52] U.S. Cl. ..... 428/71; 181/293; 181/294; 428/102; 428/246; 428/314.4; 428/340

[58] Field of Search ..... 428/71, 102, 314.4, 428/340, 314.8, 319.7, 319.9, 246; 181/293, 294

[56] References Cited

U.S. PATENT DOCUMENTS

| | | | |
|---|---|---|---|
| 2,831,198 | 4/1958 | Datlof | 2/272 |
| 3,337,876 | 8/1967 | Armstrong | 428/102 |
| 3,541,620 | 11/1970 | Chapins | 428/102 |
| 3,635,786 | 1/1972 | Hughes | 428/102 |
| 4,262,046 | 4/1981 | Etel | 428/71 |
| 4,411,467 | 10/1983 | Cziptschirsch et al. | 428/71 |
| 4,480,715 | 11/1984 | Brooks | 428/71 |
| 4,734,306 | 3/1988 | Lassiter | 428/102 |

FOREIGN PATENT DOCUMENTS

| | | |
|---|---|---|
| 989970 | 4/1965 | United Kingdom . |
| 1034581 | 6/1966 | United Kingdom . |

*Primary Examiner*—James J. Bell

*Attorney, Agent, or Firm*—Spencer & Frank

[57] ABSTRACT

A protective suit against sound waves with which it is possible to achieve a considerable reduction of the effects of sound waves on the human body. The suit material is furnished with at least two flexible soundproofing layers, of which at least one layer increases the weight per unit area of the suit, and another acts as a cushioning layer.

20 Claims, 2 Drawing Sheets

SOUND PROTECTION SUIT

BACKGROUND OF THE INVENTION

The invention relates to a protective suit against sound waves.

Sound waves impinging on the surface of the human body are also transferred to the inside of the body, especially at sound levels higher that the threshold of sound-induced pain. As a result, the circulatory system and the internal organs may be subjected in sound-induced stress in such a way as to cause circulation problems, nausea and other vegetative reaction. To protect against the transmission of sound via the surface of the body, sound protection suits (overalls) already exist which consist of thickened material such as leather or woven fabrics. The thickness of the material of such suits is approx. 1 to 2 mm. Also available on the market are sound protection jackets which cover only the torso or waistbands which offer protection to the kidneys. Many protective suits have double material thicknesses in the area around the kidneys. It is a well known fact that sound insulation is very much dependent on the weight per unit area of the soundproofing material. The weight per unit area of the previously known soundproofing materials is approx. 1.5 kg/m$^2$. The working clothing beneath the soundproofing material also acts as an air cushion. This clothing is normally not more than 3 to 5 mm thick. High sound levels up to 130 dB (A) are encountered, e.g. in production halls with fast-running hammer presses, or during repairs to and test runs of jet engines the spectrum distribution of the broadband sound which is generated covers the whole range of hearing. The insulating effect of previously known sound protection suits or items of protective clothing does not become effective until the sound frequency is 1000 Hz or more, so that all sound frequencies below this value are transmitted to the body surface. These known sound protection suits therefore offer insufficient protection against sound waves.

SUMMARY OF THE INVENTION

The invention is therefore based on the objective of creating a sound protection suit with which the transmission of sound to the surface and to the interior of the human body is reduced to a minimum, while the total weight and thickness of the suit remain within acceptable limits. In accordance with the invention, this need is fulfilled by having at least two flexible soundproofing layers, one of which constitutes a weighting layer and the other a cushioning layer. Through the use of these protective layers, the soundproofing effect of the sound protection suit according to the invention starts at considerably lower frequencies than 1000 Hz, so that sound pressure level transmitted into the body is substantially reduced especially in the medium and higher frequency ranges which are particularly important from the medical viewpoint. Further features and advantages of the invention will become evident from the following description of an example embodiment and from the drawing.

DESCRIPTION OF THE PREFERRED EMBODIMENT

Figure 1:
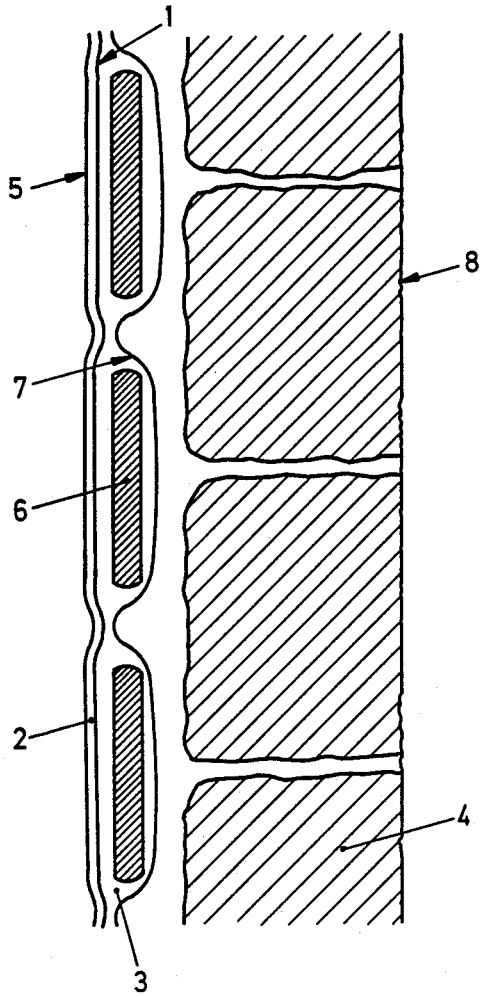
FIG. 1 shows a cross-sectional through an example embodiment of the sound protection suit with protective layers according to the invention and FIG. 2 shows a graph of the soundproofing characteristic of a sound protection suit according to the invention in comparison with a suit of conventional design.

FIG. 1 shows a cross-section through the structure of a sound protection suit with flexible protective layers. The inner side 1 of the base material 2, which could, for example, be leather or a heavy woven fabric, is lined with a weighting layer 3 together with an attached cushioning layer 4. The sound waves which are to be dampened impinge upon the outer side 5 of the base material 2. In the illustrate embodiment, the weighting layer 3 consists of laminar; i.e. plate like weighting elements 6 spaced apart and preferably arranged in a grid-type layout and is made of, e.g. an elastic synthetic material. However, it can also be made up of strip-shaped elements or consist of an unbroken flexible sheet or foil. The weight per unit area of the weighting layer 3 should lie between 3 and 6 kg/m$^2$ and preferably is 5 kg/m$^2$ the total weight of the suit is not too great. Depending on the different possible designs of the weighting layer, the latter can be glued onto the base material 2 or sewn onto it in guilt form by means of a thin, light fabric 7. In the illustrated embodiment, the cushioning layer 4 located behind the weighting layer 3 is shown as cushion-shaped in the form of quilted air cushions or cotton wool cushions which are held in position either by a light lining material 8 or by being glued to the fabric 7 or to the weighting layer 3. However, this cushioning layer 4 can also be composed of strip-shaped or laminar elements and be made of, e.g. foam rubber or synthetic foam. The cushioning layer 4 should be at least 15 mm thick, but with an eye to retaining sufficient mobility with a sound protection suit of this type it should not be thicker than 30 mm. The weight of the cushioning layer 4 is not critical since the suit also features the weighting layer 3.

Figure 2:
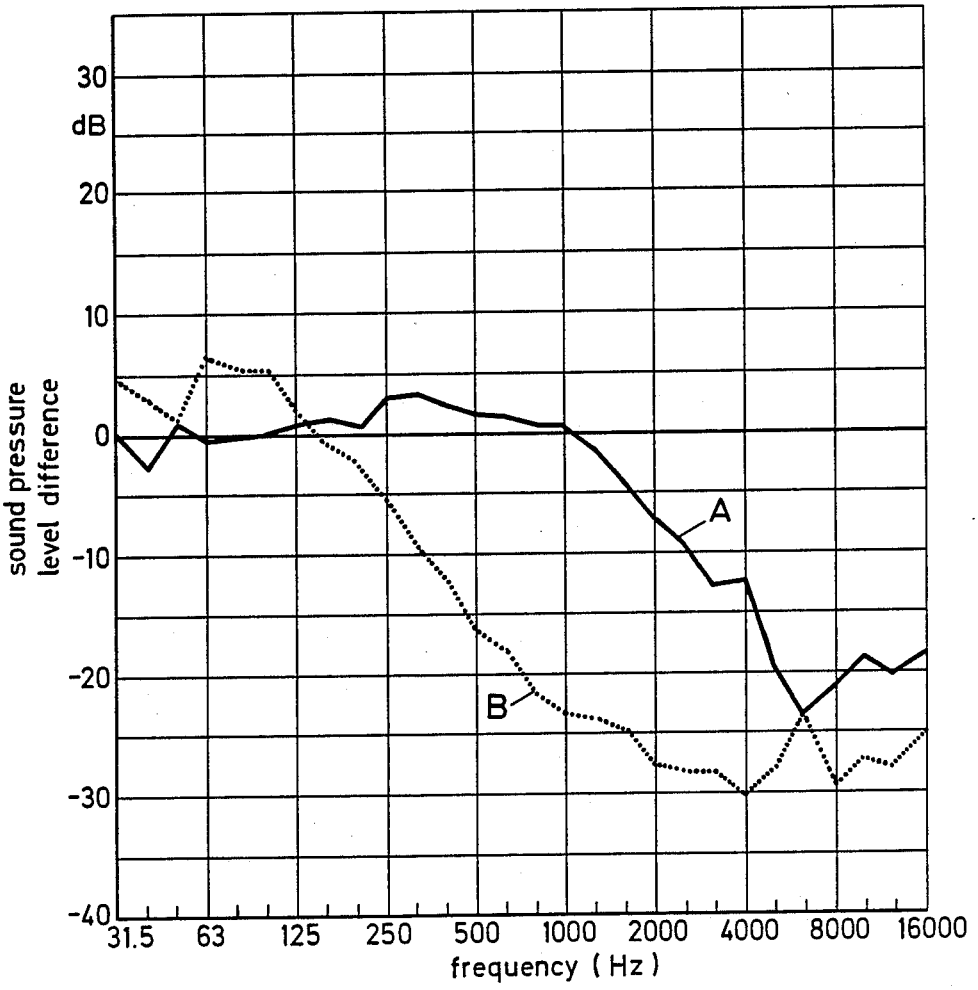

Tests to improve the soundproofing effect of sound protection suits have shown that this depends on both the weight per unit area of the suit material and on the thickness of the underlying so-called air cushion. Increasing the weight per unit area - which is naturally subject to limitations in respect of the total weight of the suit - or increasing the thickness of a cushioning layer results in the soundproofing effect starting earlier in respect of the frequencies contained in the sound spectrum. FIG. 2 shows the soundproofing effect of the sound protection suit according to the invention in comparison with a comercially available sound protection suit. Curve A relates to a leather overall without additional protective layers. Here the soundproofing effect does not start until a frequency of 1000 Hz is reached. Curve B shows the soundproofing characteristic of a sound protection suit according to the invention with two soundproofing layers comprising a weighting layer 3 with a weight per unit area of 5 kg/m$^2$ and a 30 mm thick cushioning layer 4. Here the soundproofing effect starts at as low a frequency as 160 Hz and improves by up to 25 dB at higher frequencies. With the sound protection suit according to the invention it is therefore possible to achieve a far better dampening effect on sound waves impinging on the surface of the human body and thus to achieve greater protection from the viewpoint of industrial medicine. During the production of sound protection suits according to the invention, which, if manufactured with the stated sizes of the protective layers, still retain an acceptable overall weight and sufficient flexibility, it is important to make sure that the openings for the legs and especially for the arms are well sealed off by a special seam band.

We claim:

1. In a protective suit against sound waves formed of a plurality of attached layers including a flexible outer layer and at least two flexible soundproofing layers, with one of said soundproofing layers being a weighting layer and the other of said soundproofing layers being a soft cushioning layer; the improvement wherein said weighting layer is disposed adjacent the inner surface of said outer layer and said cushioning layer is disposed behind said weighting layer in the direction toward the inside of said suit.

2. A sound protection suit according to claim 1 wherein the weighting layer (3) has a weight per unit area of of 3 to 6 kg/m$^2$, preferably of 5 kg/m$^2$.

3. A sound protection suit according to claim 1 wherein the weighting layer is formed of several laminar elements disposed in a grid-like arrangement.

4. A sound protection suit according to claim 2 wherein the weighting layer (3) is formed of strip-shaped individual elements.

5. A sound protection suit according to claim 2 wherein the weighting layer is made of an elastic synthetic material.

6. A sound protection suit according to claim 1 wherein the cushioning layer consists of laminar, strip-shaped or cushion-shaped individual elements and has a thickness of at least 15 mm.

7. A sound protection suit according to claim 6 wherein the cushioning layer consists of a very soft material, such as foam rubber, synthetic foam or cotton wool in an enclosing material.

8. A sound protection suit according to at claim 1 wherein the weighting layer and the cushioning layer are sewn quilt-like to the inside of said outer layer of the sound protection suit.

9. A sound protection suit according to claim 2 wherein the weighting layer is formed of an elastic sheet or foil.

10. A sound protection suit according to claim 2 wherein the weighting layer has a weight of 5 kg/m$^2$.

11. A sound protection suit according to claim 6 wherein the cushioning layer has a thickness of 30 mm.

12. A sound protection suit according to claim 2 wherein the cushioning layer consists of laminar, strip-shaped or cushion-shaped individual elements and has a thickness of at least 15 mm.

13. A sound protection suit according to claim 12 wherein the cushioning layer consists of a very soft material, such as foam rubber, synthetic foam or cotton wool, in an enclosing material.

14. A sound protection suit according to claim 13 wherein the weighting layer is made of an elastic synthetic material.

15. A sound protection suit according to claim 14 wherein the weighting layer is formed of several laminar elements disposed in a grid-like arrangement.

16. A sound protective suit according to claim 15 wherein the weighting layer and the cushioning layer are sewn quilt-like to the inside of the sound protection suit.

17. A sound protection suit as defined in claim 1 wherein said outer layer is formed of leather or a heavy woven fabric.

18. A sound protection suit as defined in claim 17 further comprising an inner layer formed of a light lining material forming the inside of said suit.

19. A sound protection suit as defined in claim 1 further comprising an inner layer formed of a light lining material forming the inside of said unit.

20. A sound protection suit according to claim 1 wherein the weighting layer and the cushioning layer are glued to the inside of the sound protection suit.

* * * * *